US009831078B2

(12) United States Patent
Land et al.

(10) Patent No.: US 9,831,078 B2
(45) Date of Patent: Nov. 28, 2017

(54) ION SOURCE FOR MASS SPECTROMETERS

(71) Applicant: AGILENT TECHNOLOGIES, INC., Loveland, CO (US)

(72) Inventors: Adrian Land, San Carlos, CA (US); Stuart C. Hansen, Palo Alto, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 474 days.

(21) Appl. No.: 13/688,770

(22) Filed: Nov. 29, 2012

(65) Prior Publication Data

US 2013/0193318 A1 Aug. 1, 2013

Related U.S. Application Data

(60) Provisional application No. 61/591,327, filed on Jan. 27, 2012.

(51) Int. Cl.

| | |
|---|---|
| ***H01J 49/00*** | (2006.01) |
| ***H01J 49/10*** | (2006.01) |
| ***H01J 49/14*** | (2006.01) |
| ***H01J 49/26*** | (2006.01) |
| ***H01J 49/16*** | (2006.01) |

(52) U.S. Cl.

CPC ..... *H01J 49/10* (2013.01); *H01J 49/107* (2013.01); *H01J 49/147* (2013.01); *H01J 49/162* (2013.01); *H01J 49/26* (2013.01)

(58) Field of Classification Search

CPC ..... H01J 49/00; H01J 49/02; H01J 49/0422; H01J 49/0445; H01J 49/062; H01J 49/063; H01J 49/065; H01J 49/066; H01J 49/107; H01J 49/161; H01J 49/162; H01J 49/14; H01J 49/142; H01J 49/147

USPC ..... 250/423 R, 424, 425, 426, 427, 423 P, 250/281, 282, 283, 285, 288

See application file for complete search history.

(56) References Cited

U.S. PATENT DOCUMENTS

| | | | | |
|---|---|---|---|---|
| 6,107,628 | A | 8/2000 | Smith et al. | |
| 6,583,408 | B2 | 6/2003 | Smith et al. | |
| 6,888,132 | B1 * | 5/2005 | Sheehan | H01J 49/145 250/281 |
| 7,064,322 | B2 | 6/2006 | Crawford et al. | |
| 7,495,212 | B2 | 2/2009 | Kim et al. | |
| 2002/0175278 | A1 * | 11/2002 | Whitehouse | H01J 49/0095 250/281 |
| 2003/0025074 | A1 * | 2/2003 | Li | H01J 49/107 250/288 |
| 2004/0051039 | A1 * | 3/2004 | Russ | H01J 49/004 250/288 |
| 2010/0200742 | A1 * | 8/2010 | Schultz | H01J 49/0045 250/252.1 |

(Continued)

FOREIGN PATENT DOCUMENTS

WO WO 2011131142 A1 * 10/2011 ..... H01J 49/145

OTHER PUBLICATIONS

Molecule, Nov. 22, 2013, Columbia University Press, Accessed through <http://education.yahoo.com/reference/encyclopedia/entry/molecule>.*

(Continued)

*Primary Examiner* — Jason McCormack

(57) ABSTRACT

Ion sources for use in mass spectrometry (MS) systems are described. The ion sources each comprise an ion funnel and an ionization source configured to ionize neutral analyte molecules.

27 Claims, 6 Drawing Sheets

(56) References Cited

U.S. PATENT DOCUMENTS

| | | | | |
|---|---|---|---|---|
| 2010/0301210 | A1 | 12/2010 | Bertsch et al. | |
| 2011/0109226 | A1 | 5/2011 | Cooley et al. | |
| 2011/0147575 | A1 | 6/2011 | Mordehai et al. | |
| 2012/0298853 | A1* | 11/2012 | Kurulugama ..... | H01J 49/065 250/282 |
| 2013/0026359 | A1* | 1/2013 | Kumashiro ..... | H01J 49/066 250/283 |

OTHER PUBLICATIONS

Co-pending U.S. Appl. No. 13/170,202, filed Jun. 28, 2011.
Co-pending U.S. Appl. No. 13/307,640, filed Nov. 30, 2011.
Co-pending U.S. Appl. No. 13/345,392, filed Jan. 6, 2012.
Page, et al. "Subambient Pressure Ionization with Nanoelectrospray Source and Interface for Improved Sensitivity in Mass Spectrometry", Anal. Chem. vol. 80, No. 5, p. 1800-1805, Mar. 1, 2008.
Tang, et al. "Improving Liquid Cromatography-Mass Spectrometry Sensitivity Using a Subambient Pressure Ionization with Nanoelectrospray (SPIN) Interface", J. Am. Soc. Mass Spectrom. 22, p. 1318-1325, 2011.
Co-pending U.S. Appl. No. 13/170,282, filed Jun. 28, 2011.
Co-pending U.S. Appl. No. 13/307,641, filed Nov. 30, 2011.

* cited by examiner

ION SOURCE FOR MASS SPECTROMETERS

CROSS-REFERENCE TO RELATED APPLICATIONS

The present application claims priority under 35 U.S.C. §119(e) from U.S. Provisional Patent Application 61/591,327, filed on Jan. 27, 2012 and entitled "Ion Source for Mass Spectrometers." The entire disclosure of U.S. Provisional Patent Application 61/591,327 is specifically incorporated herein by reference.

BACKGROUND

Mass spectrometry (MS) is an analytical methodology used for quantitative elemental analysis of samples. Molecules (often referred to as analytes) in a sample are ionized and separated by a spectrometer based on their respective masses. The separated analyte ions are then detected and a mass spectrum of the sample is produced. The mass spectrum provides information about the masses and in some cases the quantities of the various analyte particles that make up the sample. In particular, mass spectrometry can be used to determine the molecular weights of molecules and molecular fragments within an analyte.

Analyte ions are provided by an ion source. Analyte ions for analysis by mass spectrometry may be produced by any of a variety of ionization systems. For example, Atmospheric Pressure Matrix Assisted Laser Desorption Ionization (AP-MALDI), Atmospheric Pressure Photoionization (APPI), Electrospray Ionization (ESI), Atmospheric Pressure Chemical Ionization (APCI) and Inductively Coupled Plasma (ICP) systems may be employed to produce ions in a mass spectrometry system.

What is needed is an ion source with improved ionization efficiency independent of analyte polarity and species.

SUMMARY

In accordance with a representative embodiment, an ion source comprises: an ion funnel comprising a first opening at a first end and a second opening at a second end, the first opening configured to receive neutral analyte molecules; and an ionization device configured to ionize the neutral analyte molecules in the ion funnel.

In accordance with another representative embodiment, a method of providing ions in a mass spectrometry system is disclosed. The method comprises: introducing neutral analyte molecules to a first end of an ion funnel; ionizing the neutral analyte molecules in the ion funnel to form analyte ions; and guiding the analyte ions to a second end of the ion funnel.

BRIEF DESCRIPTION OF THE DRAWINGS

The present teachings are best understood from the following detailed description when read with the accompanying drawing figures. The features are not necessarily drawn to scale. Wherever practical, like reference numerals refer to like features.

DEFINED TERMINOLOGY

Figure 1:
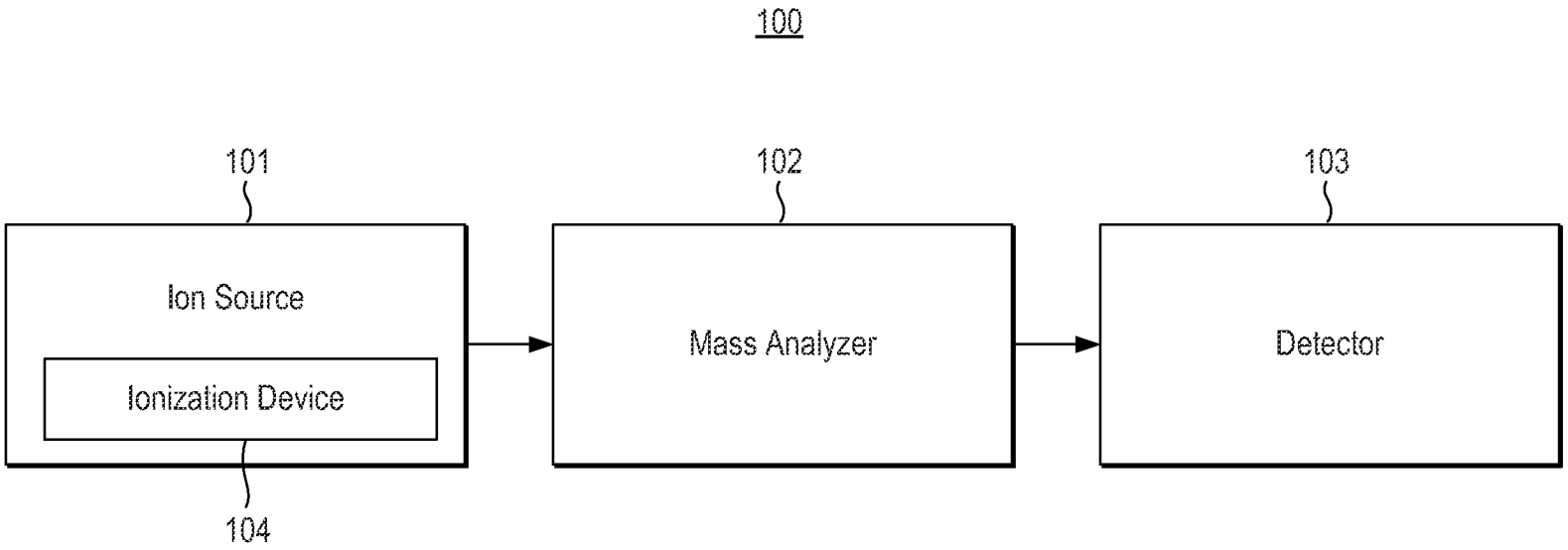
FIG. 1 shows a simplified block diagram of an MS system in accordance with a representative embodiment.

It is to be understood that the terminology used herein is for purposes of describing particular embodiments only, and is not intended to be limiting. The defined terms are in addition to the technical and scientific meanings of the defined terms as commonly understood and accepted in the technical field of the present teachings.

As used in the specification and appended claims, the terms 'a', 'an' and 'the' include both singular and plural referents, unless the context clearly dictates otherwise. Thus, for example, 'a device' includes one device and plural devices.

As used in the specification and appended claims, and in addition to their ordinary meanings, the terms 'substantial' or 'substantially' mean to with acceptable limits or degree. For example, 'substantially cancelled' means that one skilled in the art would consider the cancellation to be acceptable.

As used in the specification and the appended claims and in addition to its ordinary meaning, the term 'approximately' means to within an acceptable limit or amount to one having ordinary skill in the art. For example, 'approximately the same' means that one of ordinary skill in the art would consider the items being compared to be the same.

DETAILED DESCRIPTION

In the following detailed description, for purposes of explanation and not limitation, representative embodiments disclosing specific details are set forth in order to provide a thorough understanding of the present teachings. Descriptions of known systems, devices, materials, methods of operation and methods of manufacture may be omitted so as to avoid obscuring the description of the example embodiments. Nonetheless, systems, devices, materials and methods that are within the purview of one of ordinary skill in the art may be used in accordance with the representative embodiments.

In a representative embodiment, an ion source comprises an ion funnel and an ionization device. The ionization device is configured to ionize neutral analyte molecules introduced at a first end of the ion funnel. The ion funnel confines the ions and guides the ions from the first end to the second end. The ions are provided ultimately to an ion detector of the MS system. The ionization device may be a source of electromagnetic radiation (e.g., photoionization (PI) device), an electron ionization (EI) device, or a Penning ionization device. As described more fully below, a plurality of ionization devices may be implemented into the ion source, and are not necessarily the same type of ionization device. In certain embodiments, the ionization device is provided adjacent to a first opening at the first end of the ion funnel or outside of the ion funnel, while in other embodiments the ionization device is provided in the ion funnel. In either case a beam (e.g., photons, electrons) is directed to the neutral analyte molecules at the first end of the ion funnel and ionizes the neutral analyte molecules for measurement in the MS system.

As described more fully below, the ion source of the representative embodiments provides significant benefits over certain known ion sources. For example, the ion source of the representative embodiments provides a comparatively high efficiency of ion capture and transfer through the ion funnel. Moreover, the comparatively high pressure and comparatively low gas flow in the ion funnel provides a comparatively long "residence" time, which fosters comparatively high efficiency of ionization of analyte molecules. Furthermore, because the analytes are introduced to the ion funnel without a net electric charge, and are in either the solid phase or the gas phase, the ion sources of the representative embodiments are substantially immune to charge competition and ion suppression effects which hinder known liquid chromatography (LC) electrospray ionization (ESI) devices.

FIG. 1 shows a simplified schematic diagram of a mass spectrometer 100 in accordance with a representative embodiment. The block diagram is drawn in a more general format because the present teachings may be applied to a variety of different types of mass spectrometers. As should be appreciated as the present description continues, devices and methods of representative embodiments may be used in connection with the mass spectrometer 100. As such, the mass spectrometer 100 is useful in garnering a more comprehensive understanding of the functions and applications of the devices and method of the representative embodiments, but is not intended to be limiting of these functions and applications. The mass spectrometer 100 comprises an ion source 101, a mass analyzer 102 and a detector 103. The ion source 101 comprises an ionization device 104, which is configured to ionize a gas sample (not shown in FIG. 1) and to provide ions to the mass analyzer 102. Details of ionization device 104 are described in accordance with representative embodiments below. Other components of the mass spectrometer 100 comprise apparatuses known to one of ordinary skill in the art and are not described in detail to avoid obscuring the description of representative embodiments. For example, the mass analyzer 102 may be a quadrupole mass analyzer, an ion trap mass analyzer, or a time-of-flight (TOF) mass analyzer, among others.

Figure 2:
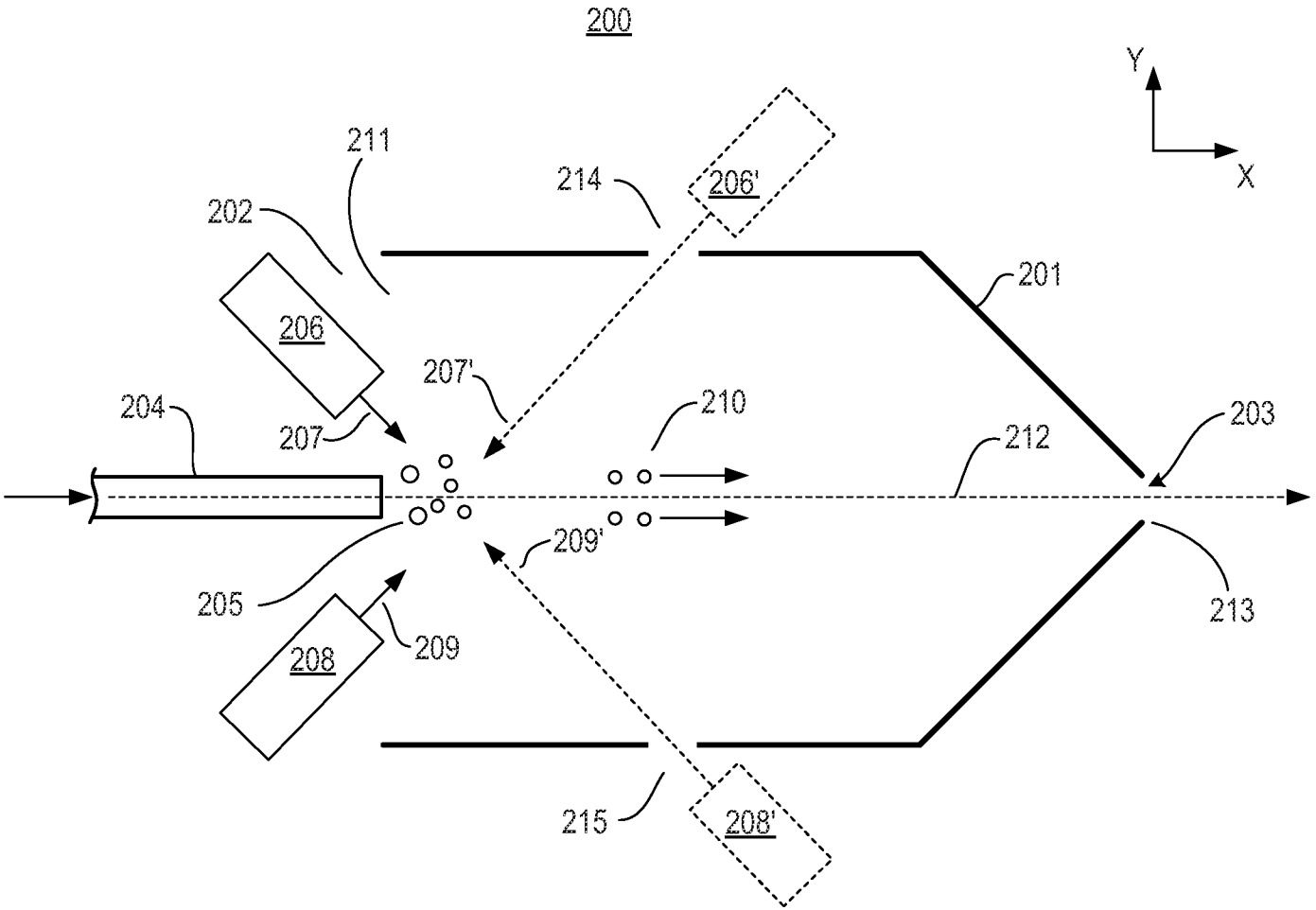
FIG. 2 shows a cross-sectional view of an ion source in accordance with a representative embodiment.

FIG. 2 shows a perspective view of an ion source 200 in accordance with a representative embodiment. The ion source 200 may be included in mass spectrometer 100 described above. The ion source 200 comprises an ion funnel 201 (sometimes referred to below as "first ion funnel 201") having a first end 202 and a second end 203. In the depicted embodiment, an inlet capillary 204 is provided at the first end 202 and is connected to (e.g., in fluid communication with) a gas chromatography (GC) column (not shown) or a liquid chromatography (LC) column (not shown). The inlet capillary 204 includes a vapor comprising a solvent or a carrier gas comprising neutral analyte molecules 205, which are provided into the ion funnel 201 at the first end 202. As described more fully below, the neutral analyte molecules 205 are electrically neutral, and are in a gaseous phase.

The ion source 200 comprises a first ionization device 206 and, optionally, a second ionization device 208 disposed adjacent to a first opening 211 of the ion funnel 201. As described more fully below, the present teachings are not limited to the use of one ionization device, but rather the use of a plurality of ionization devices is contemplated. The first ionization device 206 and the second ionization device 208 usefully ionize the neutral analyte molecules 205 that emerge from the inlet capillary 204. The first ionization device 206 and the second ionization device 208 may be the same type of ionization device. Alternatively, the first ionization device 206 and the second ionization device 208 may be different types of ionization device.

First ionization device 206 emits a first beam 207 that is incident on the neutral analyte molecules 205 and second ionization device 208 emits a second beam 209 incident on the neutral analyte molecules 205. The first beam 207 and the second beam 209 are characteristic of the type of emission from the first ionization device 206 and the second ionization device 208. The present teachings contemplate that the first ionization device 206 and the second ionization device 208 are configured to provide one or more of electromagnetic radiation, or electrons, or metastable atoms or stable ions, or a combination thereof. As such, the first beam 207 and the second beam 209 can be one or more of electromagnetic radiation, electrons and ions and metastable atoms. As should be appreciated by one of ordinary skill in the art, the mechanism of ionization (e.g., Penning, x-ray, light, electron impact and ion impact) are selected depending on the spectral information desired of the neutral analyte molecules 205. In certain applications one or more mechanisms for ionization are contemplated.

In a representative embodiment, the first ionization device 206 and the second ionization device 208 are each photoionization (PI) devices. Generally, PI sources contemplated include, but are not limited to a resonance lamp, a laser (e.g., an excimer laser), a synchrotron, a microplasma source, a dielectric barrier discharge (DBD) excimer photon generator, an alternating current (AC) excited gas discharge source and a direct current (DC) excited gas discharge source.

In one representative embodiment, the first beam 207, or the second beam 209, or both, comprise photons in the vacuum ultraviolet (VUV) region of the electromagnetic spectrum selected VUV photons (generally 6 eV-12.4 eV), which are sufficiently energetic to electronically excite and/or ionize most chemical species. Vacuum ultraviolet (VUV) light is generally defined as light having wavelengths in the range of 100-200 nanometers.

Notably, most chemical species have ionization energies in the range 8 eV-11 eV; some common solvents have ionization energies of 12 eV or more; and a few chemical species have ionization energies of 15 eV or greater. Thus the photon energy of the first beam 207, the second beam 209, or both, can be selected to ionize most analytes, but not certain solvents or carrier gas molecules. For many contemplated applications of the present teachings, the photon energy of the first and second beams 207, 209 is selected to be at the middle energy region of the VUV range, e.g., 10 eV.

In certain embodiments, the first ionization device 206 and/or the second ionization device 208 may be VUV photoionization devices including a window, or "windowless" VUV photoionization devices. So-called "windowless" photoionization devices allow a greater portion of the light spectrum to be incident on a sample. Illustratively, the VUV ionization source may be as described in one or more of the following commonly owned U.S. Patent Applications: "Microplasma Device with Cavity for Vacuum Ultraviolet Irradiation of Gases and Methods of Making and Using the Same" to James E. Cooley, et al., which has published as U.S. Patent Application Publication 20110109226; "Windowless Ionization Device" to James E. Cooley, et al. (U.S. patent application Ser. No. 13/170, 202) filed on Jun. 28, 2011 to J. Cooley, et al.; and "Ionization Device" to James E. Cooley, et al. (U.S. patent application Ser. No. 13/307, 641) filed on Nov. 30, 2011. The disclosures of these commonly owned patent applications and patent application publication are specifically incorporated herein by reference.

The referenced patent applications and patent application publication to Cooley, et al. are so-called "microplasma ionization devices." These devices produce plasma ions, plasma electrons and photons. It is sometimes desirable to prevent plasma ions and plasma electrons from reaching the neutral analyte molecules 205 to be ionized, but rather only allow the plasma photons (e.g., VUV photons) to be incident on the neutral analyte molecules to effect ionization. The referenced patent applications to Cooley, et al. are configured to provide only photons. The present teachings contemplate the implementation of such ionization devices as the first ionization device 206, or the second ionization device 208, or both.

However, it is not essential that the first ionization device 206, or the second ionization device 208, or both, be configured to allow only photons to be incident on the neutral analyte molecules 205. Rather, in certain applications, in addition to photons, ions and/or electrons comprising the plasma may be directed from the first ionization device 206 and/or the second ionization device 208 to the neutral analyte molecules 205 to obtain different spectral data resulting from ionization and fragmentation of the neutral analyte molecules 205, for example. As such, in accordance with a representative embodiment, first beam 207 and/or second beam 209 could comprise ions (e.g., plasma ions) to effect chemical ionization in the ion funnel 201 (similar to APCI mentioned above). Similarly, first beam 207 and/or second beam 209 could comprise beams of electrons. Notably, electron ionization (EI) is widely used as a benchmark ionization source, and use of electron beam(s) for the first beam 207 and/or the second beam 209 will usefully generate characteristic fragmentation patterns. Potentially, this type of source would allow the use of existing spectral libraries. The ions and/or electrons may come from a plasma source or from another source (i.e. electrons from a standard EI thermionic filament emission).

The ion funnel 201 comprises electrodes (not shown in FIG. 2) for generation of time dependent and static electric fields for confining the analyte ions in the radial direction about an axis of symmetry 212, and for guiding analyte ions 210 toward a second opening 213 at the second end 203 of the ion funnel 201. A power supply (not shown) is configured to apply-opposite phases of a time dependent voltage (e.g., a radio frequency (RF) voltage) to the electrodes to create an ion-confining electrodynamic field in the ion funnel 201. In a representative embodiment, the RF voltage typically has a frequency ($\omega$) in the range of approximately 1.0 MHz to approximately 100.0 MHz. The frequency is one of a number of ion guide parameters useful in achieving efficient beam compression in the radial direction and mass range of analytes. In addition, a direct current (DC) voltage is also applied and creates an electrical potential difference to guide ions in the x-direction in the coordinate system depicted in FIG. 2.

In operation, the neutral analyte molecules 205 are provided at the first opening 211 of the ion funnel 201. The first beam 207, or the second beam 209, or both, are incident on the neutral analyte molecules 205, which are ionized and form analyte ions 210. The time-dependent and DC electric fields generated in the ion funnel 201 serve to compress the analyte ions 210 in the radial direction relative to axis of symmetry 212, and propel the analyte ions 210 along axis of symmetry 212 and in the x-direction in the coordinate system depicted in FIG. 2.

The placement of the first ionization device 206 and the second ionization device 208 adjacent to the first opening 211 but not in the ion funnel 201 is illustrative but not essential. Rather, the ionization devices may be provided at other locations relative to the ion funnel 201, as depicted in FIG. 2. For example, and as depicted in FIG. 2, first ionization device 206' and second ionization device 208' can be disposed at other locations relative to the ion funnel 201. In the representative embodiment depicted, the first beam 207' from the first ionization device 206' travels through a first side opening 214, which may include a window or be windowless. The first beam 207' is incident on the neutral analyte molecules 205, which are ionized and form analyte ions 210. Similarly, in addition to or instead of first ionization device 206', second ionization device 208' may be disposed at other locations relative to the ion funnel 201. In the representative embodiment depicted, the second beam 209' from the second ionization device 208' travels through a second side opening 215, which may include a window or be windowless. The second beam 209' is incident on the neutral analyte molecules 205, which are ionized and form analyte ions 210.

It is noted that the number and locations of the ionization devices depicted in FIG. 2 are not intended to be limiting. Rather, more than two ionization devices may be provided in the ion source 200. Additionally, the ionization source(s) may be provided in other locations relative to the ion funnel 201 and in other combinations than specifically depicted in FIG. 2. Finally, the number and locations of side openings (e.g., first and second side openings 214, 215) are determined by the number and locations of the ionization devices.

The time-dependent and DC electric fields generated in the ion funnel 201 serve to compress the analyte ions 210 in the radial direction relative to axis of symmetry 212, and propel the analyte ions 210 along axis of symmetry 212 and in the x-direction in the coordinate system depicted in FIG. 2.

Among other benefits, the ion source 200 fosters a greater degree of ionization of neutral analyte molecules 205 by providing a comparatively long "residence time" at the first end 202 of the ion funnel 201. In particular, in a representative embodiment, the ion funnel 201 is pressurized to approximately 1 Torr to approximately 10 Torr with an inert "buffer" gas (e.g., air, nitrogen or other suitable inert gas). Collisions with the buffer gas impede the progress of neutral analyte molecules 205 toward the second end 203 of the ion funnel 201 (i.e., along the x axis in the coordinate system depicted in FIG. 2). These collisions cause stagnation near the point near the output of the inlet capillary 204 where the first beam 207 is aimed, or where the first beam 207 and the second beam 209 converge. The flow dynamics of the gas injected into and pumped out of the funnel, as well as other conditions inside the funnel may be modified to affect the residence time of neutral analyte molecules 205 near the output of the inlet capillary 204 disposed on the ion funnel 201. After ionization, the DC gradient electric field in the ion funnel 201 serves to separate the newly formed analyte ions 210 and force the analyte ions 210 toward the second end 203 of the ion funnel 201 (i.e., along the x axis in the coordinate system depicted in FIG. 2), and consequently toward the mass analyzer located in tandem with the ion funnel 201 (e.g., mass analyzer 102 depicted in FIG. 1). Neutral solvent and/or buffer gas molecules are eventually pumped away. Beneficially, if the first beam 207 and/or the second beam 209 comprises photons in the VUV spectrum, neutral analyte molecules 205 are ionized preferentially over other species (e.g., solvent and/or buffer gas molecules).

Figure 3:
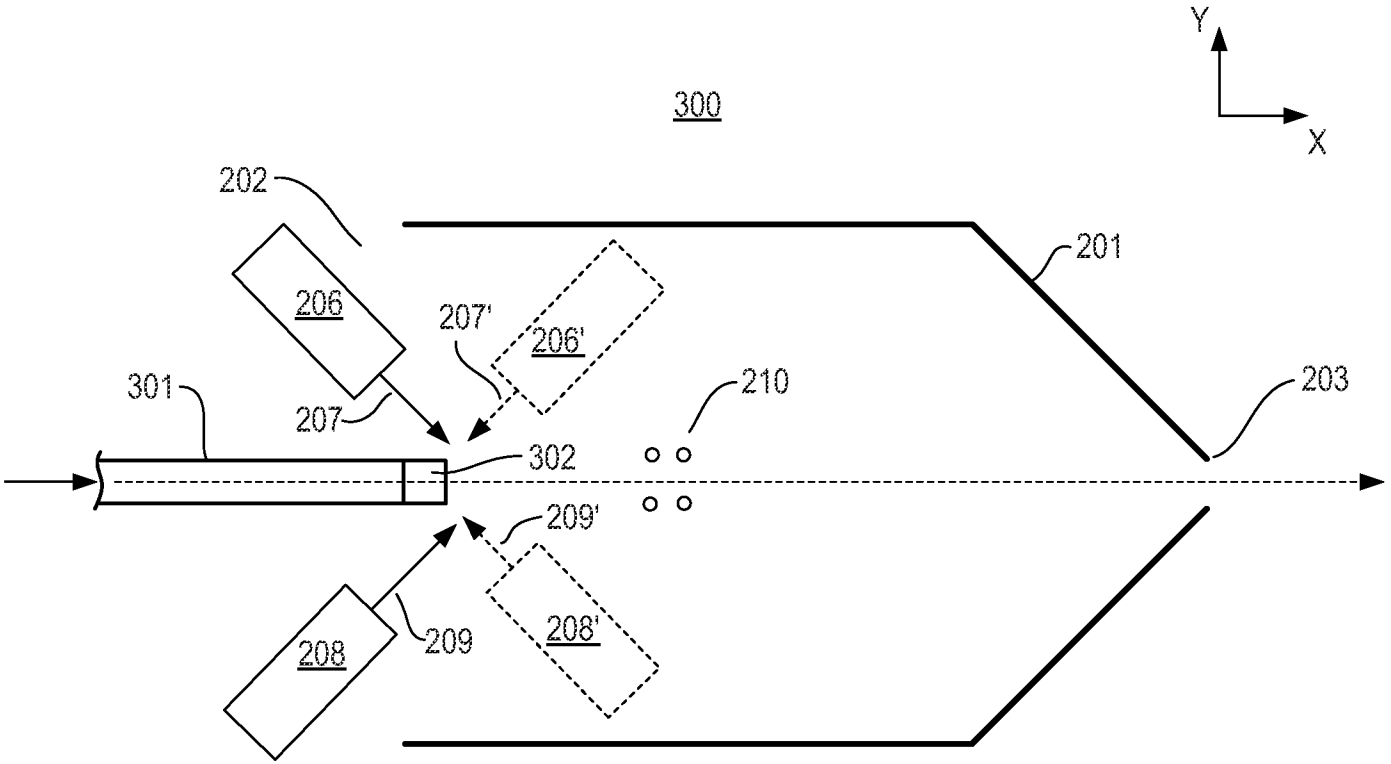
FIG. 3 shows a cross-sectional view of an ion source in accordance with a representative embodiment.

FIG. 3 shows a perspective view of an ion source 300 in accordance with a representative embodiment. The ion source 300 may be included in mass spectrometer 100 described above. Many aspects of the ion source 300 are common to those of ion source 200 described above. As such, common aspects are not described in detail to avoid obscuring the description of representative embodiments.

The ion source 300 comprises ion funnel 201 having a first end 202 and a second end 203. In the depicted embodiment, sample probe 301 is provided at the first end 202 and comprises a solid sample 302 of neutral analyte molecules 205, which are provided into the ion funnel 201 at the first end 202. Like neutral analyte molecules 205, the analyte molecules of the solid sample 302 are electrically neutral.

In operation, the solid sample 302 is provided at the first opening 211 of the ion funnel 201. The first beam 207, or the second beam 209, or both, are incident on the solid sample 302. The neutral analyte molecules 205 that comprise the solid sample 302 are ionized and form analyte ions 210. The time-dependent and DC electric fields generated in the ion funnel 201 serve to compress the analyte ions 210 in the radial direction relative to axis of symmetry 212, and propel the analyte ions 210 along axis of symmetry 212 and in the x-direction in the coordinate system depicted in FIG. 2.

The placement of the first ionization device 206 and the second ionization device 208 adjacent to the first opening 211 or at other locations relative to but not "inside" the ion funnel 201 is illustrative but not essential. Rather, the ionization devices may be provided inside the ion funnel 201, as depicted in FIG. 3 (depicted as first ionization device 206' and second ionization device 208'). The first beam 207', or the second beam 209', or both, are incident on the solid sample 302.

The neutral analyte molecules that comprise the solid sample 302 are ionized and form analyte ions 210. The time-dependent and DC electric fields generated in the ion funnel 201 serve to compress the analyte ions 210 in the radial direction relative to axis of symmetry 212, and propel the analyte ions 210 along axis of symmetry 212 and in the x-direction in the coordinate system depicted in FIG. 2.

It is noted that the number and locations of the ionization devices depicted in FIGS. 2 and 3 are not intended to be limiting. Rather, more than two ionization devices may be provided in the ion sources 200, 300. Additionally, the ionization source(s) may be provided in other locations relative to the ion funnel 201 and in other combinations than specifically depicted in FIGS. 2 and 3. Moreover, the number and locations of side openings (e.g., first and second side openings 214, 215) are determined by the number and locations of the ionization devices.

Figure 4:
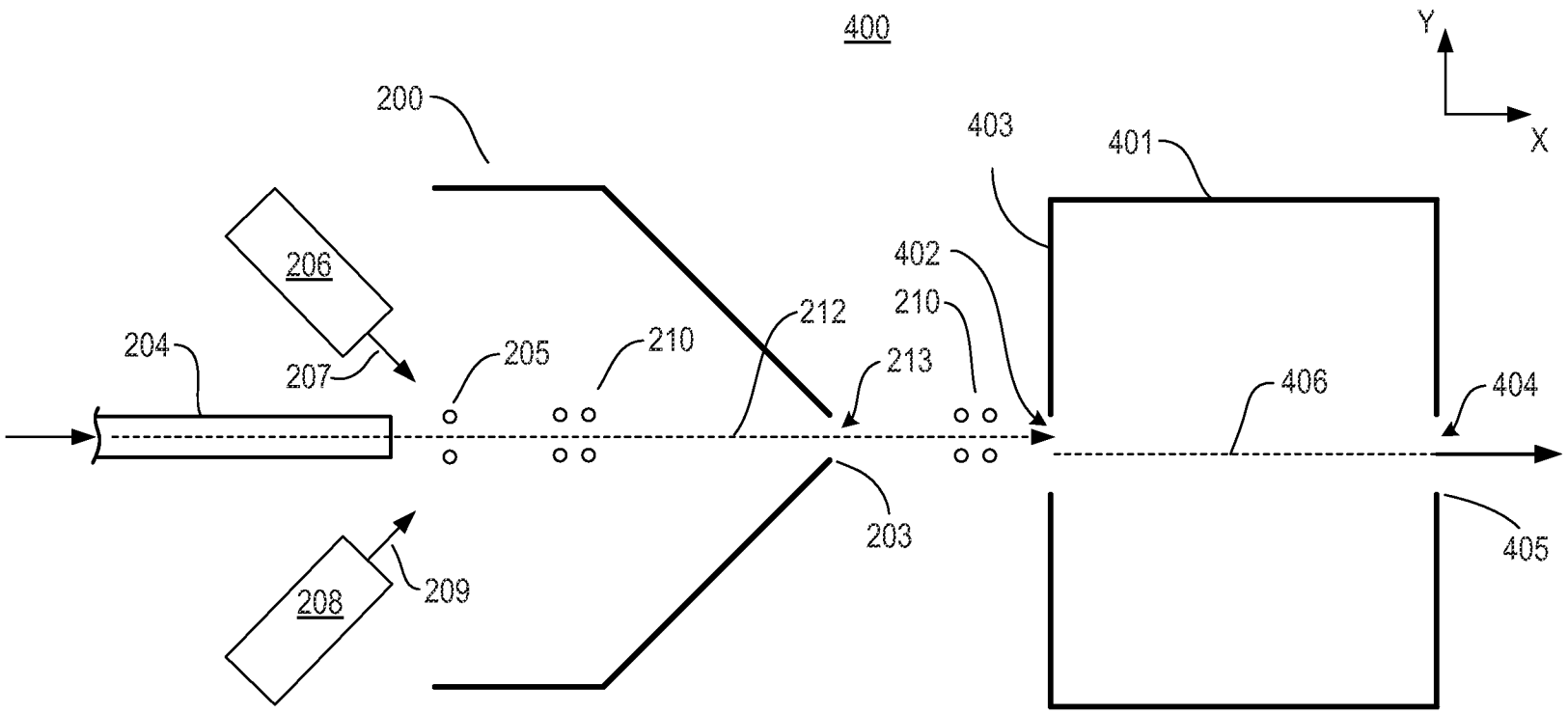
FIG. 4 shows a cross-sectional view of an ion source in accordance with a representative embodiment.

FIG. 4 shows a cross-sectional view of an ion source 400 in accordance with a representative embodiment. The ion source 400 comprises ion source 200 described above. Alternatively, ion source 300 could be provided instead of ion source 200 if a solid sample 302 was being analyzed in a mass spectrometer. Many of the details of the ion source 200 comprising (first) ion funnel 201 are common to those provided above in the description of the representative embodiments depicted in FIG. 2. Many of these common details are not repeated to avoid obscuring the description of the presently described embodiments.

The ion source 400 comprises a second ion funnel 401. The second ion funnel 401 is disposed in tandem with ion funnel 201 (referred to as "first ion funnel 201" ) in the description of FIG. 4), and comprises a first opening 402 at a first end 403 and a second opening 404 at a second end 405. The first opening 402 is configured to receive analyte ions 210 from the second end 203 of the first ion funnel 201. The second ion funnel 401 is provided to further confine the analyte ions 210 and provide the analyte ions 210 to a mass analyzer (e.g., mass analyzer 102) of a mass spectrometer.

The second ion funnel 401 is a known ion guide and, by the application of time-dependent and static electric fields established therein, is configured to confine the analyte ions 210 in the radial dimension around axis of symmetry 212, and propel the ions toward the mass analyzer (i.e., in the x-direction of the coordinate system shown in FIG. 4). Illustratively, the second ion funnel 401 may be as described commonly owned U.S. patent application Ser. No. 13/345,392 entitled "Radio Frequency (RF) Ion Guide for Improved Performance in Mass Spectrometers" to G. Perelman, et al. and filed on Jan. 6, 2012. Alternatively, the second ion funnel 401 may be as described in commonly owned U.S. Patent Application Publication 20100301210 entitled "Converging Multipole Ion Guide for Ion Beam Shaping" to Bertsch, et al. Still alternatively, the second ion funnel 401 may be as described in commonly owned U.S. Pat. No. 7,064,322 to Crawford, et al. and titled "Mass Spectrometer Multipole Device." The disclosures of the referenced commonly owned patent application, patent application publication and patent are specifically incorporated herein by reference. Moreover, other known ion funnels can be incorporated as the second ion funnel 401. It is emphasized that the ion guides of the referenced patent application, patent application publication and patent are merely illustrative, and other ion funnels that are within the purview of one of ordinary skill in the art may be implemented for the second ion funnel 401.

In operation, the neutral analyte molecules 205 are provided at the first opening 211 of the ion funnel 201. The first beam 207, or the second beam 209, or both, are incident on the neutral analyte molecules 205, which are ionized and form analyte ions 210. The time-dependent and DC electric fields generated in the ion funnel 201 serve to compress the analyte ions 210 in the radial direction relative to axis of symmetry 212, and propel the analyte ions 210 along axis of symmetry 212 and in the x-direction in the coordinate system depicted in FIG. 4. The analyte ions 210 are then provided at the first opening 402 of the second ion funnel 401, which further confines the analyte ions 210 and propels them through the second opening 404 for transmission to a mass analyzer (not shown in FIG. 4).

Beneficially, the incorporation of the second ion funnel 401 provides another stage of differential pumping whereby many of the buffer gas molecules exiting the second opening 213 are pumped away before they can traverse the second ion funnel 401 and enter the mass analyzer (e.g., mass analyzer 102) or any ion optics that may be used to couple the second ion funnel 401 to the mass analyzer. The pressure inside the second ion funnel 401 is lower than the pressure inside the first funnel by a factor of approximately 10, so the second opening 404 presents a reduced gas load to the subsequent high vacuum region.

In a representative embodiment, the axis of symmetry 212 of the first ion funnel 201 is offset from an axis of symmetry 406 of the second ion funnel 401 so that molecules do not have a direct line of sight from the second opening 213 of the first ion funnel 201 to the second opening 404 of the second ion funnel 401. Further details of offsetting the axis of symmetry 212 of the first ion funnel 201 from the axis of symmetry 406 of the second ion funnel 401 can be found in commonly owned U.S. Patent Application Publication 20110147575 entitled "Ion Funnel for Mass Spectroscopy" to A. Mordehai, et al. The disclosure of this patent application publication is specifically incorporated herein by reference.

Figure 5:
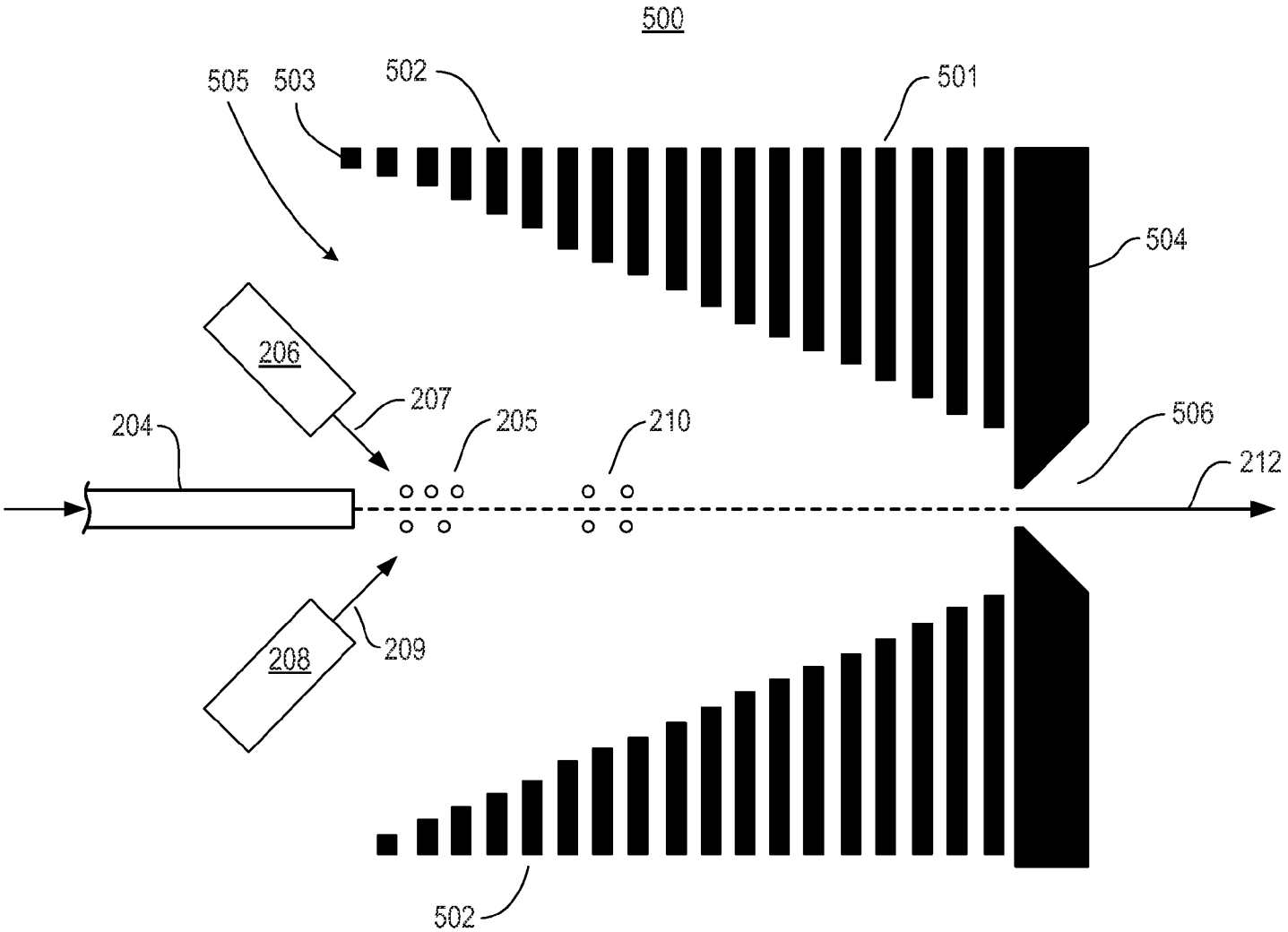
FIG. 5 shows a cross-sectional view of an ion source in accordance with a representative embodiment.

FIG. 5 shows a cross-sectional view of an ion source 500 in accordance with a representative embodiment. The ion source 500 maybe included in mass spectrometer 100 described above. Many aspects of the ion source 500 are common to those of ion sources 200, 300 described above. As such, common aspects are not described in detail to avoid obscuring the description of representative embodiments. Moreover, the representative embodiment presently described relates to ionization of neutral analyte molecules 205 from the inlet capillary 204 that are in the gas phase. The principles described in connection with the ion source 500 are equally applicable to the ionization of a solid sample disposed on a probe, such as described in connection with FIG. 3.

The ion source 500 comprises an ion funnel 501, comprising a plurality of electrodes 502. The plurality of electrodes 502 may be concentric circular electrodes such as described in above-referenced U.S. patent application Ser. No. 13/345,392 to Perelman, et al. Moreover, the plurality of electrodes 502, their configuration and electrical connections thereto may be as described in, for example, U.S. Pat. No. 6,107,628 to Smith, et al,; U.S. Pat. No. 6,583,408 to Smith, et al.; and U.S. Pat. No. 7,495,212 to Kim, et al. The respective entire disclosures of the Smith, et al. patents and the Kim, et al, patent are specifically incorporated herein by reference.

The electrodes 502 are connected to a power supply/voltage source (not shown in FIG. 5) configured to apply opposite phases of a time dependent voltage (e.g., a radio frequency (RF) voltage such as described above) to adjacent pairs of electrodes 502, thereby creating an electrodynamic field in the radial direction around axis of symmetry 212. The electrodynamic field serves to confine the analyte ions 210 in the radial direction around the axis of symmetry 212.

The power supply/voltage source is also selectively connected electively to the successive electrodes 502 to establish a direct current (DC) voltage between a first end 503 and a second end 504. Thereby, a DC potential drop is established between the first end 503 and a second end 504 to effect drift of analyte ions 210 from the first end 503 to the second end 504 of the ion funnel 501.

The ion source 500 comprises first ionization device 206 and, optionally, second ionization device 208 disposed adjacent to a first opening 505 at a first end 503 of the ion funnel 501. As noted above, the present teachings are not limited to the use of one ionization device, but rather the use of a plurality of ionization devices is contemplated. The first ionization device 206 and the second ionization device 208 usefully ionize the neutral analyte molecules 205 that emerge from the inlet capillary 204 at a first opening 505 at the first end 503.

First ionization device 206 emits first beam 207 that is incident on the neutral analyte molecules 205 and second ionization device 208 emits second beam 209 incident on the neutral analyte molecules 205. The first beam 207 and the second beam 209 are characteristic of the type of emission from the first ionization device 206 and the second ionization device 208. The present teachings contemplate that the first ionization device 206 and the second ionization device 208 are configured to provide one or more of electromagnetic radiation, electrons, ions and metastable atoms. As such, the first beam 207 and the second beam 209 can be one or more of electromagnetic radiation, electrons, ions and metastable atoms, As noted above, the mechanism of ionization (e.g., Penning, x-ray, light, electron impact and ion impact) is selected depending on the spectral information desired of the neutral analyte molecules 205, In certain applications one or more mechanisms for ionization are contemplated.

In operation, the neutral analyte molecules 205 are provided by the inlet capillary 204 at first opening 505 at a first end 503 of the ion funnel 501. The first beam 207, or the second beam 209, or both, are incident on the neutral analyte molecules 205, which are ionized and form analyte ions 210. The time-dependent and DC electric fields generated in the ion funnel 501 serve to compress the analyte ions 210 in the radial direction relative to axis of symmetry 212, and propel the analyte ions 210 along axis of symmetry 212 and toward a second opening 506 at the second end 504 of the ion funnel 501 (in the x-direction in the coordinate system depicted in FIG. 5).

Figure 6:
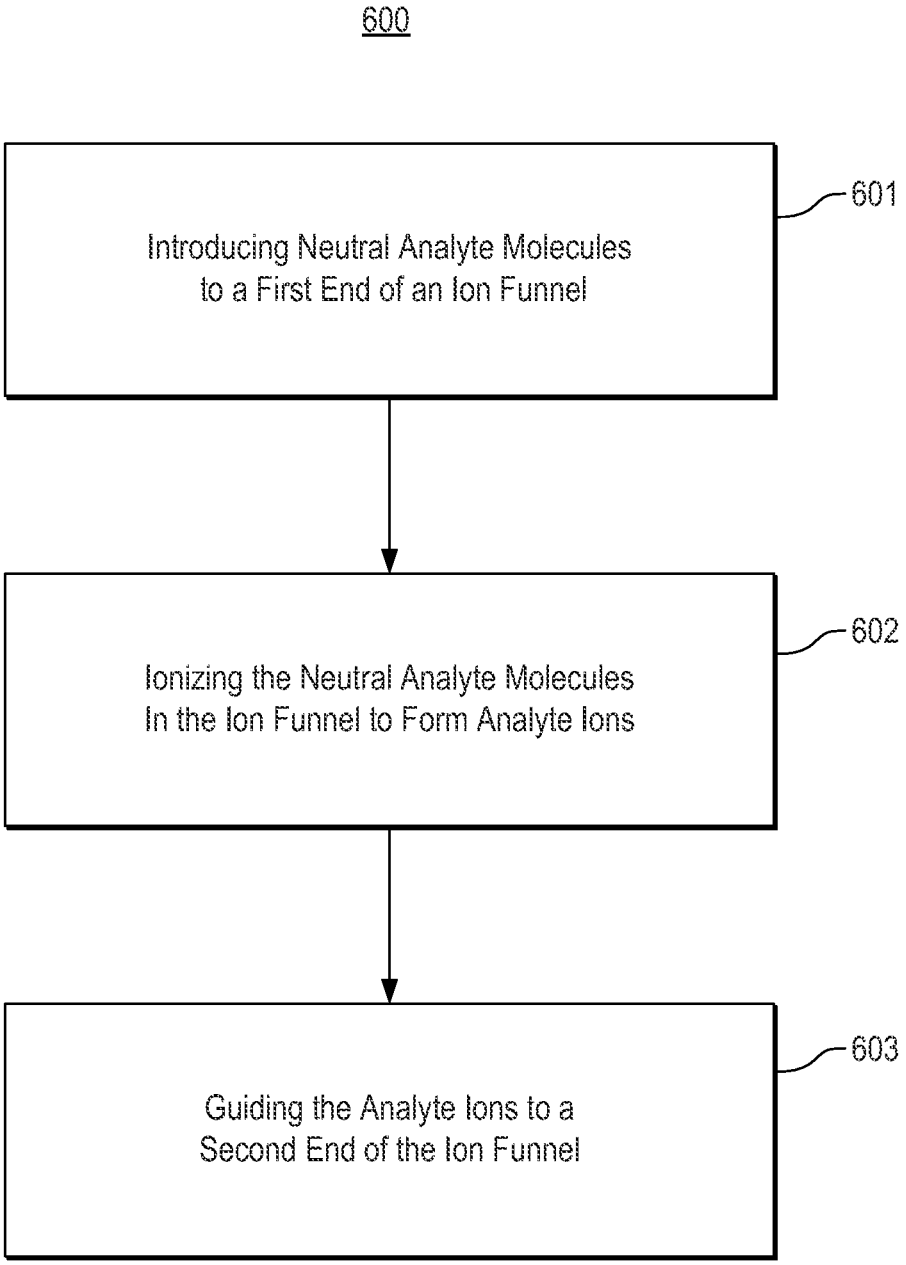
FIG. 6 shows a flow-chart of a method of providing ions in a mass spectrometry system in accordance with a representative embodiment.

FIG. 6 shows a flow-chart of a method 600 of providing ions in a mass spectrometry system in accordance with a representative embodiment. The method 600 is implemented using the ion sources described above in connection with FIGS. 1~5.

At 601, the method comprises introducing neutral analyte molecules to a first end of an ion funnel. At 602 the method comprises ionizing the neutral analyte molecules in the ion funnel to form analyte ions. At 603, the method comprises guiding the analyte ions to a second end of the ion funnel.

In view of this disclosure it is noted that the methods and devices can be implemented in keeping with the present teachings. Further, the various components, materials, structures and parameters are included by way of illustration and example only and not in any limiting sense. In view of this disclosure, the present teachings can be implemented in other applications and components, materials, structures and equipment needed to implement these applications can be determined, while remaining within the scope of the appended claims.

The invention claimed is:

1. An ion source, comprising:

an ion funnel comprising a first opening at a first end, a second opening at a second end disposed at a distance from the first opening along an axis, and a plurality of electrodes between the first end and the second end, wherein the first opening is configured to receive neutral analyte molecules, and the electrodes are configured to generate a time-dependent electric field for confining ions in a radial direction orthogonal to the axis and to generate a static electric field oriented along the axis for guiding ions toward the second opening; and an ionization device disposed in the ion funnel and configured to emit electromagnetic radiation or electrons to ionize the neutral analyte molecules in the ion funnel.

2. An ion source as claimed in claim 1, further comprising an inlet capillary configured to deliver the neutral analyte molecules to the first opening.

3. An ion source as claimed in claim 2, wherein the inlet capillary is in fluid communication with a gas chromatograph.

4. An ion source as claimed in claim 1, wherein the ionization device comprises one of: an electromagnetic radiation source and an electron source.

5. An ion source as claimed in claim 4, wherein the electromagnetic radiation source comprises a vacuum ultraviolet (VUV) source.

6. An ion source as claimed in claim 5, wherein the VUV source comprises one of: a microplasma VUV source, an excimer VUV source, a direct current (DC) excited gas discharge source, an alternating current (AC) excited gas discharge source, or a laser source.

7. An ion source as claimed in claim 5, wherein the VUV source is positioned so that photons from the VUV source interact with the neutral analyte molecules inside the ion funnel.

8. An ion source as claimed in claim 7, wherein the VUV source is a first VUV source, and the ion source further comprises a second VUV source, the first VUV source and the second VUV source each being positioned at an angle relative to an axis of symmetry of the ion funnel.

9. An ion source as claimed in claim 8, further comprising a third VUV source and a fourth VUV source each positioned so that photons from the second VUV source, the third VUV source and the fourth VUV source interact with the neutral analyte molecules inside the ion funnel.

10. An ion source as claimed in claim 1, wherein the neutral analyte molecules are provided in a mixture with a solvent vapor or in a carrier gas.

11. An ion source as claimed in claim 4, wherein the ionization device is a first ionization device and the ion source further comprises a second ionization device.

12. An ion source as claimed in claim 11, wherein the second ionization device comprises one of an electromagnetic radiation source and an electron source, and the first ionization device is different than from the second ionization device.

13. An ion source as claimed in claim 11, wherein the second ionization device comprises one of: an electromagnetic radiation source and an electron source and the first ionization device is the same as the second ionization device.

14. An ion source as claimed in claim 11, wherein the ion source further comprises a third ionization device and a fourth ionization device.

15. An ion source as claimed in claim 14, wherein the third ionization source comprises one of an electromagnetic radiation source and an electron source and the fourth ionization device comprises one of an electromagnetic radiation source and an electron source.

16. An ion source as claimed in claim 14, wherein the first ionization device, the second ionization device, the third ionization device and the fourth ionization device are the same type of ionization device.

17. An ion source as claimed in claim 14, wherein at least one of the first ionization device, the second ionization device, the third ionization device and the fourth ionization device are different.

18. A mass spectrometer comprising the ion source of claim 1.

19. A mass spectrometer as claimed in claim 18, further comprising:

a second ion funnel, in tandem with the first ion funnel, comprising a first opening at a first end and a second opening at a second end, the first opening configured to receive analyte ions from the second end of the first ion funnel.

20. A method of providing ions in a mass spectrometry system, the method comprising:

introducing neutral analyte molecules to a first end of an ion funnel;

providing an ionization device inside the ion funnel;

ionizing the neutral analyte molecules by operating the ionization device to emit electromagnetic radiation or electrons in the ion funnel to form analyte ions;

guiding the analyte ions to a second end of the ion funnel disposed at a distance from the first end along an axis, by operating the ion funnel to generate a time-dependent electric field for confining the analyte ions in a radial direction orthogonal to the axis and to generate a static electric field oriented along the axis.

21. A method as claimed in claim 20, wherein the introducing neutral analyte molecules comprises providing neutral analyte molecules in a vapor comprising a solvent or carrier gas.

22. A method as claimed in claim 20, wherein the introducing neutral analyte molecules comprises providing a solid comprising the analyte molecules.

23. A method as claimed in claim 20, wherein the ionizing comprises directing electromagnetic radiation, or electrons, or metastable atoms, or stable ions, or a combination thereof at the neutral analyte molecules.

24. A method as claimed in claim 23, wherein electromagnetic radiation has a wavelength in the vacuum ultraviolet (VUV) spectrum.

25. An ion source as claimed in claim 8, wherein the second VUV source is positioned inside the ion funnel.

26. An ion source, comprising:

an ion funnel comprising a first opening at a first end, a second opening at a second end disposed at a distance from the first opening along an axis, and a plurality of electrodes between the first end and the second end, wherein the first opening is configured to receive neutral analyte molecules, and the electrodes are configured to generate a time-dependent electric field for confining ions in a radial direction orthogonal to the axis and to generate a static electric field oriented along the axis for guiding ions toward the second opening; and a VUV source configured to emit VUV photons, the VUV source disposed outside and along a side of the ion funnel, the VUV source being disposed adjacent to an opening in the side of the ion funnel, and being configured to ionize the neutral analyte molecules in the ion funnel.

27. An ion source as claimed in claim 26, wherein the VUV source is a first VUV source, and the ion source further comprises a second VUV source configured to emit VUV photons, the second VUV source disposed outside and along another side of the ion funnel, the second VUV source being disposed adjacent to another opening in the other side of the ion funnel, and being configured to ionize the neutral analyte molecules in the ion funnel.

* * * * *